US009853372B2

(12) United States Patent
Anderson et al.

(10) Patent No.: US 9,853,372 B2
(45) Date of Patent: Dec. 26, 2017

(54) CENTER CONDUCTOR TIP

(71) Applicant: John Mezzalingua Associates, LLC, Liverpool, NY (US)

(72) Inventors: Cody Anderson, Cicero, NY (US); Ian J. Baker, Baldwinsville, NY (US); Christopher P. Natoli, Baldwinsville, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 15/473,690

(22) Filed: Mar. 30, 2017

(65) Prior Publication Data

US 2017/0207556 A1 Jul. 20, 2017

Related U.S. Application Data

(63) Continuation of application No. 14/849,146, filed on Sep. 9, 2015, now Pat. No. 9,633,761.

(Continued)

(51) Int. Cl.
*H01B 7/28* (2006.01)
*H01R 9/05* (2006.01)

(Continued)

(52) U.S. Cl.
CPC ..... *H01R 9/0524* (2013.01); *H01B 7/28* (2013.01); *H01B 7/29* (2013.01); *H01B 7/30* (2013.01);

(Continued)

(58) Field of Classification Search
CPC ..... H01R 2103/00; H01R 13/5219; H01R 2201/18; H01R 2201/24; H01R 24/50;

(Continued)

(56) References Cited

U.S. PATENT DOCUMENTS 2,480,280 A * 8/1949 Bergan ..... H01R 4/203 219/118
3,054,981 A 9/1962 Malek ..... H01R 24/40 333/260

(Continued)

FOREIGN PATENT DOCUMENTS

EP 2219267 A1 2/2009
FR EP 2219267 A1 8/2010 ..... H01R 24/564

OTHER PUBLICATIONS

USPTO (ISA/US), International Search Report an Written Opinion of the ISA from PCT/US2013/064682 dated Mar. 11, 2014 (13 pgs.).

*Primary Examiner* — William H Mayo, III
*Assistant Examiner* — Krystal Robinson
(74) *Attorney, Agent, or Firm* — Barclay Damon LLP

(57) ABSTRACT

A tip end conductor for an inner conductor of a coaxial cable, comprising a first portion engaging a first region of the outermost tip to mechanically engage the inner conductor and a second portion, axially inboard of the first portion, engaging a second region of the outermost tip to electrically engage the inner conductor. The first and second portions define first and second diameter dimensions, respectively, wherein the first diameter dimension is less than the second diameter dimension, and wherein the first portion of the tip end conductor includes a mechanically irregular surface for being press fit onto, and producing, a mechanical interlock along a first region of the terminal end of the inner conductor.

20 Claims, 15 Drawing Sheets

Related U.S. Application Data

(60) Provisional application No. 62/084,042, filed on Nov. 25, 2014.

(51) Int. Cl.
*H01B 7/29* (2006.01)
*H01R 4/56* (2006.01)
*H01B 7/30* (2006.01)
*H01B 11/18* (2006.01)

(52) U.S. Cl.
CPC ..... *H01B 11/1817* (2013.01); *H01R 4/56* (2013.01); *H01R 9/0521* (2013.01)

(58) Field of Classification Search
CPC ..... H01R 4/489; H01R 24/40; H01R 13/625; H01R 2201/20; H01R 13/112; H01R 13/2421; H01R 13/6271; H01R 24/54; H01R 9/05; H01R 11/18; H01R 13/62
See application file for complete search history.

(56) References Cited

U.S. PATENT DOCUMENTS 3,238,494 A 3/1966 Bentley ..... H01R 9/0518 174/75 C
3,245,027 A 4/1966 Ziegler, Jr. ..... H01R 9/0518 174/88 C
3,352,963 A 11/1967 Homrig ..... H01B 17/305 174/151
3,977,752 A * 8/1976 Freitag ..... H01R 9/05 439/394
4,129,744 A * 12/1978 Cunningham ..... H01R 4/625 174/94 R
4,561,716 A 12/1985 Acke ..... H01R 24/40 439/578
4,585,289 A 4/1986 Bocher ..... H01R 24/40 439/312
5,154,636 A 10/1992 Vaccaro et al.
5,217,391 A 6/1993 Fisher, Jr.
5,269,701 A 12/1993 Leibfried, Jr.
5,284,449 A 2/1994 Vaccaro
5,518,420 A 5/1996 Pitschi
5,795,188 A 8/1998 Harwath
5,938,474 A 8/1999 Nelson
5,984,723 A 11/1999 Wild
6,027,373 A 2/2000 Gray et al.
6,159,046 A 12/2000 Wong
6,840,803 B2 1/2005 Wlos et al.
7,209,838 B1 4/2007 Wright et al.
7,217,154 B2 5/2007 Harwath
7,275,957 B1 10/2007 Wlos et al.
7,357,671 B2 4/2008 Wild et al.
7,381,089 B2 6/2008 Hosler, Sr.
7,384,307 B1 6/2008 Wang
7,488,209 B2 2/2009 Vaccaro
7,527,512 B2 5/2009 Montena
7,537,482 B2 * 5/2009 Burris ..... H01R 9/05 439/578
7,637,774 B1 12/2009 Vaccaro
7,934,954 B1 * 5/2011 Chawgo ..... H01R 9/0524 439/578
8,453,320 B2 6/2013 Van Swearingen et al.
9,017,102 B2 4/2015 Natoli
2001/0046802 A1 * 11/2001 Perry ..... H01R 24/52 439/352
2005/0159044 A1 7/2005 Harwath et al.
2009/0233482 A1 9/2009 Chawgo et al.
2010/0317225 A1 * 12/2010 Montena ..... H01R 13/622 439/578
2011/0230083 A1 * 9/2011 Anderson ..... H01R 13/5213 439/521
2011/0239451 A1 10/2011 Montena et al.
2011/0239455 A1 10/2011 Montena et al.
2011/0312210 A1 * 12/2011 Chawgo ..... H01R 9/0524 439/460
2012/0088405 A1 * 4/2012 Wild ..... H01R 24/564 439/585
2012/0088407 A1 4/2012 Natoli ..... H01R 24/564 439/585
2012/0125654 A1 5/2012 Van Swearingen et al.
2012/0129383 A1 5/2012 Swearingen ..... H01R 9/0503 439/449
2012/0129388 A1 5/2012 Vaccaro et al.
2012/0129390 A1 5/2012 Van Swearingen et al.
2012/0129391 A1 5/2012 Van Swearingen et al.
2013/0143439 A1 * 6/2013 Nugent ..... H01R 9/0518 439/585
2013/0178097 A1 * 7/2013 Wild ..... H01R 13/623 439/583
2014/0113486 A1 * 4/2014 Wild ..... H01R 4/029 439/578
2015/0332809 A1 * 11/2015 Natoli ..... H01R 4/029 174/74 R

* cited by examiner

CENTER CONDUCTOR TIP

PRIORITY CLAIM

This application is a Continuation of U.S. Non-Provisional patent application Ser. No. 14/849,146, filed Sep. 9, 2015, which is the Non-Provisional Utility Patent Application of, and claims the benefit and priority of, U.S. Provisional Patent Application Ser. No. 62/084,042, filed on Nov. 25, 2014. The specifications of all such applications are hereby incorporated by reference in their entirety.

BACKGROUND

Coaxial cables are typically connected to interface ports, or corresponding connectors, for the operation of various electronic devices, such as cellular communications towers. Many coaxial cables are installed on cell towers which expose the coaxial cables to harsh weather environments including wind, rain, ice, temperature extremes, vibration, etc.

A typical coaxial cable/connector includes inner and outer conductors each having several interconnected, internal components. Over time, due to certain harsh environmental conditions, these internal components can lose mechanical and/or electrical contact with the interconnected components resulting in a decrease/loss of performance. For example, loose internal parts can cause undesirable levels of passive intermodulation (PIM) which, in turn, can impair the performance of electronic devices. PIM can occur when signals, at two or more frequencies, mix in a non-linear manner to produce spurious signals. The spurious signals can interfere with, or otherwise disrupt, the proper operation of the electronic devices. Unacceptably high levels of PIM in terminal sections of the coaxial cable can disrupt communication between sensitive receiver and transmitter equipment on the tower and lower-powered cellular devices. Disrupted communication can result in dropped calls or severely limited data rates.

An example of such component integration relates to the prepared end of a coaxial cable where the tip end of a center conductor engages a female RF cable connector. More specifically, the center conductor typically comprises an aluminum core having a copper outer cladding. This combination of materials is used to minimize costs by manufacturing the core (constituting 99% of the center conductor), from a low cost aluminum, and the outer cladding (constituting a small fraction of the total conductor weight), from a highly conductive, but significantly more expensive copper material. To augment the electrical contact at the tip, an electrically compatible end cap or contact can be attached to the outermost tip end of the center conductor. The female RF cable connector which engages the end cap may be fabricated from the same material as that used in the manufacture of the copper outer cladding, or other electrically compatible material such as brass.

While the addition of a highly conductive end cap can improve performance, difficulties can be encountered when attaching the end cap to the copper clad aluminum center conductor. That is, the outer cladding, which is relatively thin to minimize cost, is easily removed when connecting a tip end contact to the terminal end of the conductor. As such, it can be difficult to prepare the tip end of the center conductor without removing all or most of the thin conductive cladding. Accordingly, it can be difficult to produce a robust mechanical connection while maintaining a highly conductive electrical path from the center conductor to the tip end contact, i.e., without effecting a weld between the components due to current induced heat or micro-arcing therebetween.

Additionally, dimensional changes within the connector can adversely impact the impedance and, consequently, the passive intermodulation (PIM) produced within the coaxial cable. That is, an increase in diameter can alter the impedance of the connector which must, in turn, be compensated by the structure of the connector, i.e., the outer dimensions of the connector. Since the cable dimensions are essentially fixed, few options are available to the designer to main the impedance along the length of the connector. Accordingly, to maintain low levels of PIM, the designer can do little more than introduce new materials having different material properties when such materials become available.

Therefore, there is a need to overcome, or otherwise lessen the effects of, the disadvantages and shortcomings described above.

SUMMARY

A tip end conductor is provided for an inner conductor of a coaxial cable, comprising a first portion engaging a first region of the outermost tip to mechanically engage the inner conductor and a second portion, axially inboard of the first portion, engaging a second region of the outermost tip to electrically engage the inner conductor. The first and second portions define first and second diameter dimensions, respectively, wherein the first diameter dimension is less than the second diameter dimension, and wherein the first portion of the tip end conductor includes a mechanically irregular surface for being press fit onto, and producing, a mechanical interlock along a first region of the terminal end of the inner conductor.

BRIEF DESCRIPTION OF THE DRAWINGS

Additional features and advantages of the present disclosure are described in, and will be apparent from, the following Brief Description of the Drawings and Detailed Description.

DETAILED DESCRIPTION

Overview—Wireless Communication Networks

In one embodiment, wireless communications are operable based on a network switching subsystem ("NSS"). The NSS includes a circuit-switched core network for circuit-switched phone connections. The NSS also includes a general packet radio service architecture which enables mobile networks, such as 2G, 3G and 4G mobile networks, to transmit Internet Protocol ("IP") packets to external networks such as the Internet. The general packet radio service architecture enables mobile phones to have access to services such as Wireless Application Protocol ("WAP"), Multimedia Messaging Service ("MSS") and the Internet.

A service provider or carrier operates a plurality of centralized mobile telephone switching offices ("MTSOs"). Each MTSO controls the base stations within a select region or cell surrounding the MTSO. The MTSOs also handle connections to the Internet and phone connections.

Figure 1:
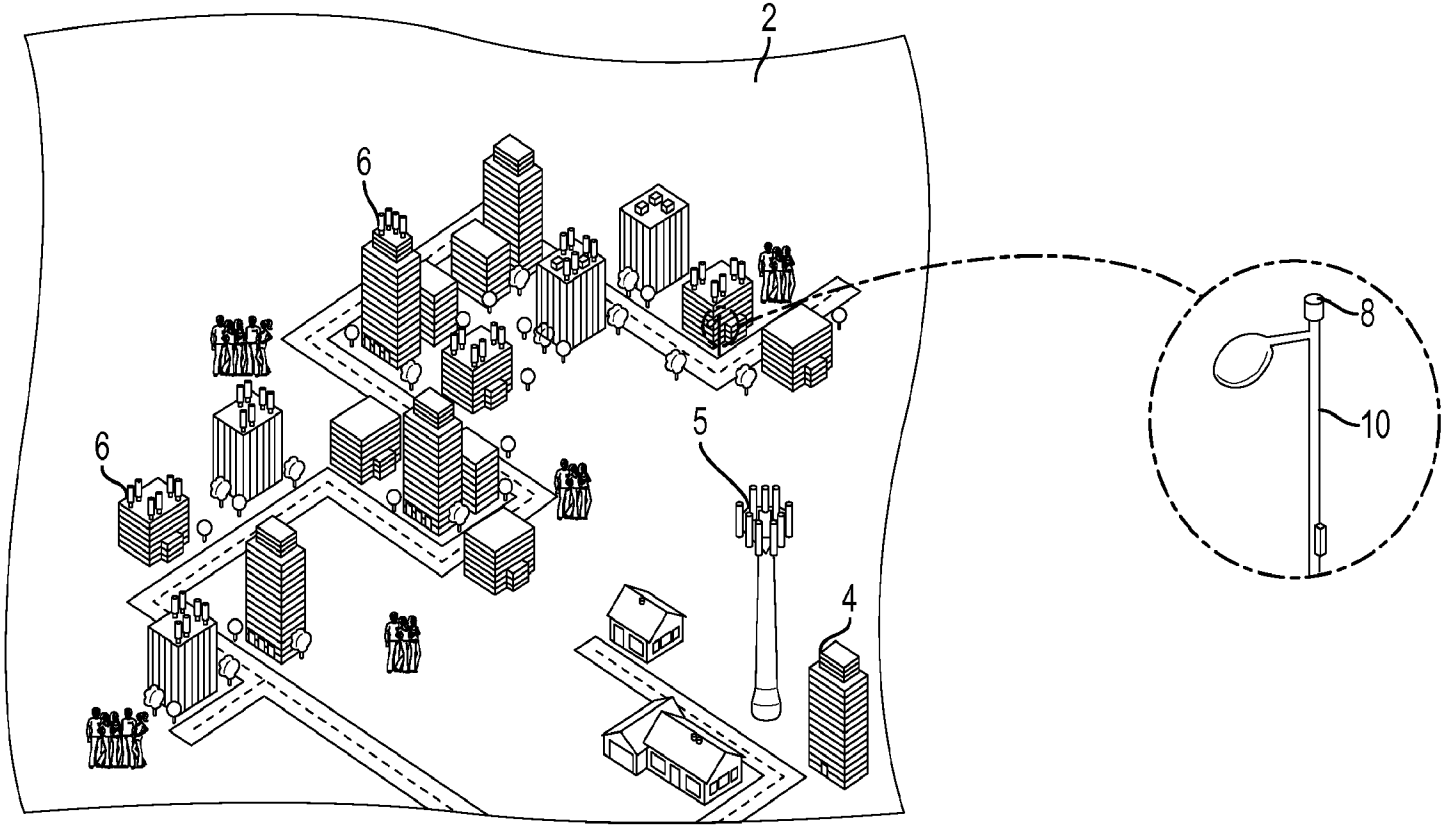
FIG. 1 is a schematic diagram illustrating an example of one embodiment of an outdoor wireless communication network.

Referring to FIG. 1, an outdoor wireless communication network 2 includes a cell site or cellular base station 4. The base station 4, in conjunction with cellular tower 5, serves communication devices, such as mobile phones, in a defined area surrounding the base station 4. The cellular tower 5 also communicates with macro antennas 6 on building tops as well as micro antennas 8 mounted to, for example, street lamps 10.

The cell size depends upon the type of wireless network. For example, a macro cell can have a base station antenna installed on a tower or a building above the average rooftop level, such as the macro antennas 5 and 6. A micro cell can have an antenna installed at a height below the average rooftop level, often suitable for urban environments, such as the street lamp-mounted micro antenna 8. A picocell is a relatively small cell often suitable for indoor use.

Figure 2:
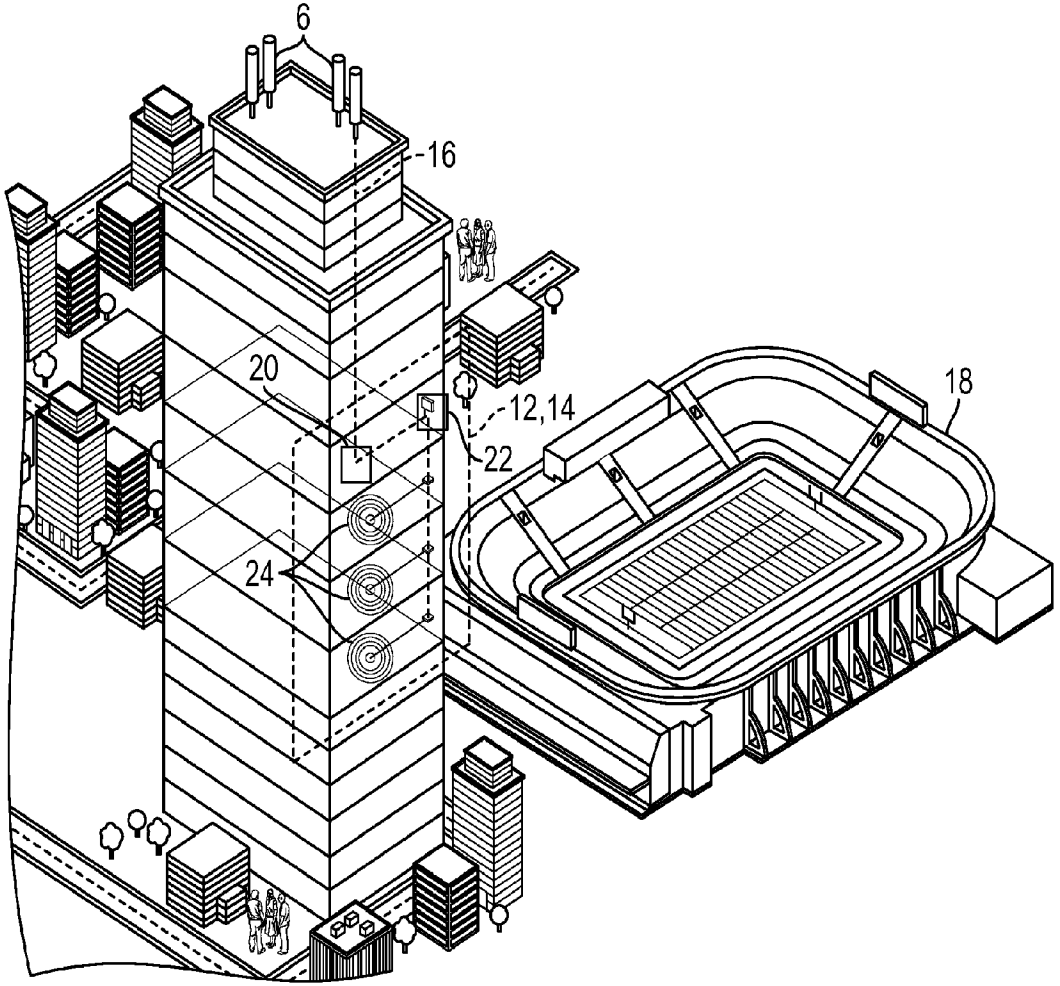
FIG. 2 is a schematic diagram illustrating an example of one embodiment of an indoor wireless communication network.

As illustrated in FIG. 2, an indoor wireless communication network 12 includes an active distributed antenna system ("DAS") 14. The DAS 14 can, for example, be installed in a high rise commercial office building 16, a sports stadium 8 or a shopping mall. In one embodiment, the DAS 14 includes macro antennas 6 coupled to a radio frequency ("RF") repeater 20. The macro antennas 6 receive signals from a nearby base station. The RF repeater 20 amplifies and repeats the received signals. The RF repeater 20 is coupled to a DAS master unit 22 which, in turn, is coupled to a plurality of remote antenna units 24 distributed throughout the building 16. Depending upon the embodiment, the DAS master unit 22 can manage over one hundred remote antenna units 24 in a building. In operation, the master unit 22, as programmed and controlled by a DAS manager, is operable to control and manage the coverage and performance of the remote antenna units 24 based on the number of repeated signals fed by the repeater 20. It should be appreciated that a technician can remotely control the master unit 22 through a Local Area Network (LAN) connection or wireless modem.

Depending upon the embodiment, the RF repeater 20 can be an analog repeater that amplifies all received signals, or the RF repeater 20 can be a digital repeater. In one embodiment, the digital repeater includes a processor and a memory device or data storage device. The data storage device stores logic in the form of computer-readable instructions. The processor executes the logic to filter or clean the received signals before repeating the signals. In one embodiment, the digital repeater does not need to receive signals from an external antenna, but rather, has a built-in antenna located within its housing.

Base Stations

Figure 3:
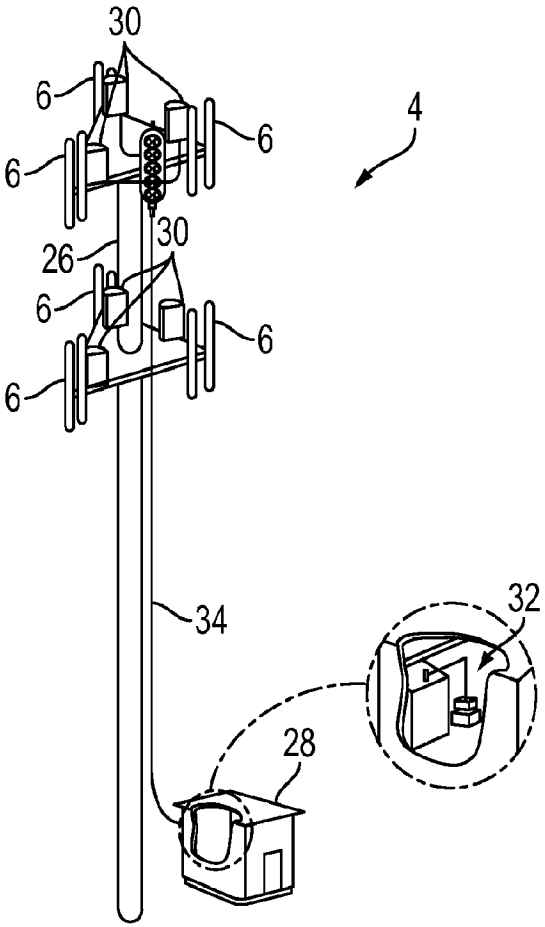
FIG. 3 is an isometric view of one embodiment of a base station illustrating a tower and ground shelter.

In one embodiment illustrated in FIG. 3, the base station 4 includes a tower 26 and a ground shelter 28 proximal to the tower 26. In this example, a plurality of exterior antennas 6 and remote radio heads 30 are mounted to the tower 26. The shelter 28 encloses base station equipment 32. Depending upon the embodiment, the base station equipment 32 includes electrical hardware operable to transmit and receive radio signals and to encrypt and decrypt communications with the MTSO. The base station equipment 32 also includes power supply units and equipment for powering and controlling the antennas and other devices mounted to the tower 26.

In one embodiment, a distribution line 34, such as coaxial cable or fiber optic cable, distributes signals that are exchanged between the base station equipment 32 and the remote radio heads 30. Each remote radio head 30 is operatively coupled, and mounted adjacent, a group of associated macro antennas 6. Each remote radio head 30 manages the distribution of signals between its associated macro antennas 6 and the base station equipment 30. In one embodiment, the remote radio heads 30 extend the coverage and efficiency of the macro antennas 6. The remote radio heads 30, in one embodiment, have RF circuitry, analog-to-digital/digital-to-analog converters and up/down converters.

Antennas

The antennas, such as macro antennas 6, micro antennas 8 and remote antenna units 24, are operable to receive signals from communication devices and send signals to the communication devices. Depending upon the embodiment, the antennas can be of different types, including, but not limited to, directional antennas, omni-directional antennas, isotropic antennas, dish-shaped antennas, and microwave antennas. Directional antennas can improve reception in higher traffic areas, along highways, and inside buildings like stadiums and arenas. Based upon applicable laws, a service provider may operate omni-directional cell tower signals up to a maximum power, such as 100 watts, while the service provider may operate directional cell tower signals up to a higher maximum of effective radiated power ("ERP"), such as 500 watts.

An omni-directional antenna is operable to radiate radio wave power uniformly in all directions in one plane. The radiation pattern can be similar to a doughnut shape where the antenna is at the center of the donut. The radial distance from the center represents the power radiated in that direction. The power radiated is maximum in horizontal directions, dropping to zero directly above and below the antenna.

An isotropic antenna is operable to radiate equal power in all directions and has a spherical radiation pattern. Omni-directional antennas, when properly mounted, can save energy in comparison to isotropic antennas. For example, since their radiation drops off with elevation angle, little radio energy is aimed into the sky or down toward the earth where it could be wasted. In contrast, isotropic antennas can waste such energy.

In one embodiment, the antenna has: (a) a transceiver moveably mounted to an antenna frame; (b) a transmitting data port, a receiving data port, or a transceiver data port; (c) an electrical unit having a PC board controller and motor; (d) a housing or enclosure that covers the electrical unit; and (e) a drive assembly or drive mechanism that couples the motor to the antenna frame. Depending upon the embodiment, the transceiver can be tiltably, pivotably or rotatably mounted to the antenna frame. One or more cables connect the antenna's electrical unit to the base station equipment 32 for providing electrical power and motor control signals to the antenna. A technician of a service provider can reposition the antenna by providing desired inputs using the base station equipment 32. For example, if the antenna has poor reception, the technician can enter tilt inputs to change the tilt angle of the antenna from the ground without having to climb up to reach the antenna. As a result, the antenna's motor drives the antenna frame to the specified position. Depending upon the embodiment, a technician can control the position of the moveable antenna from the base station, from a distant office or from a land vehicle by providing inputs over the Internet.

Data Interface Ports

Generally, the networks 2 and 12 include a plurality of wireless network devices, including, but not limited to, the base station equipment 32, one or more radio heads 30, macro antennas 6, micro antennas 8, RF repeaters 20 and remote antenna units 24. As described above, these network devices include data interface ports which couple to connectors of signal-carrying cables, such as coaxial cables and fiber optic cables. In the example illustrated in FIG. 4, the tower 36 supports a radio head 38 and macro antenna 40. The radio head 38 has interface ports 42, 43 and 44 and the macro antenna 40 has antenna ports 45 and 47. In the example shown, the coaxial cable 48 is connected to the radio head interface port 42, while the coaxial cable jumpers 50 and 51 are connected to radio head interface ports 44 and 45, respectively. The coaxial cable jumpers 50 and 51 are also connected to antenna interface ports 45 and 47, respectively.

The interface ports of the networks 2 and 12 can have different shapes, sizes and surface types depending upon the embodiment. In one embodiment illustrated in FIG. 5, the interface port 52 has a tubular or cylindrical shape. The interface port 52 includes: (a) a forward end or base 54 configured to abut the network device enclosure, housing or wall 56 of a network device; (b) a coupler engager 58 configured to be engaged with a cable connector's coupler, such as a nut; (c) an electrical ground 60 received by the coupler engager 58; and (d) a signal carrier 62 received by the electrical grounder 60.

Figure 6:
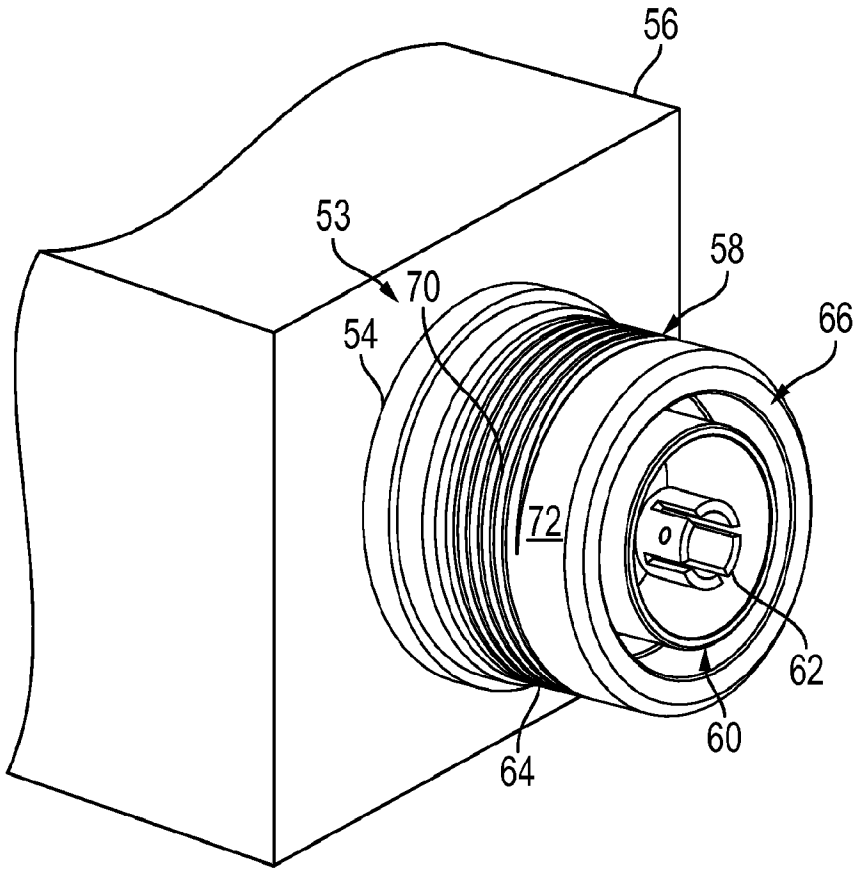
FIG. 6 is an isometric view of another embodiment of an interface port.
Figure 7:
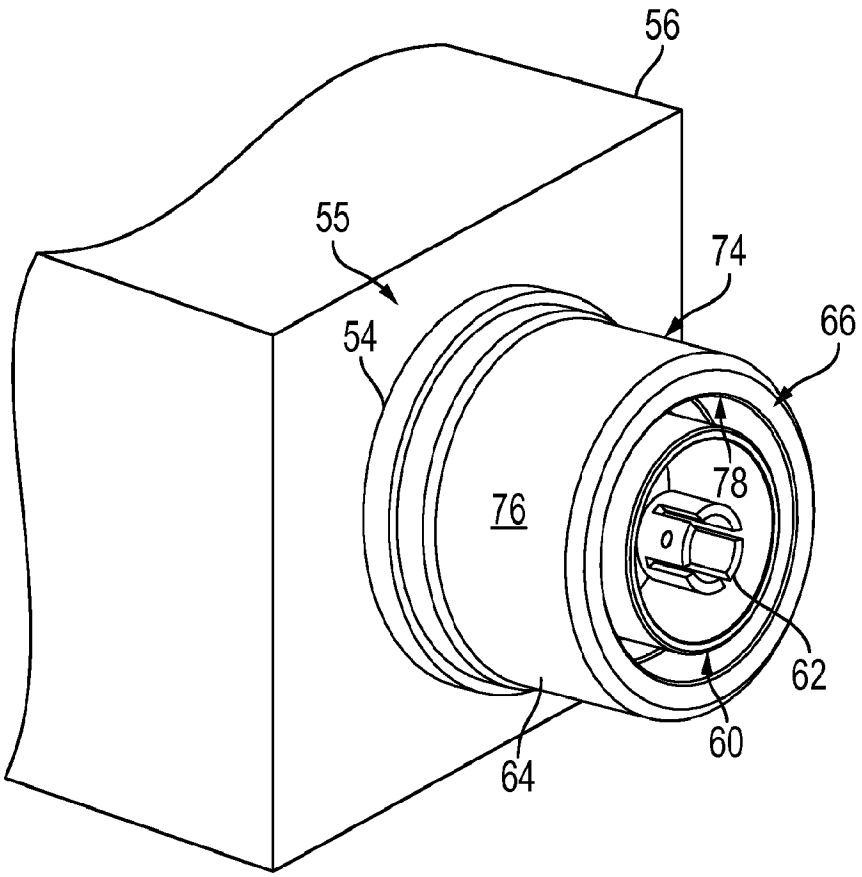
FIG. 7 is an isometric view of yet another embodiment of an interface port.

In the illustrated embodiment, the base 54 has a collar shape with a diameter larger than the diameter of the coupler engager 58. The coupler engager 58 is tubular in shape, has a threaded, outer surface 64 and a rearward end 66. The threaded outer surface 64 is configured to threadably mate with the threads of the coupler of a cable connector, such as connector 68 described below. In one embodiment illustrated in FIG. 6, the interface port 53 has a forward section 70 and a rearward section 72 of the coupler engager 58. The forward section 70 is threaded, and the rearward section 72 is non-threaded. In another embodiment illustrated in FIG. 7, the interface port 55 has a coupler engager 74. In this embodiment, the coupler engager 74 is the same as coupler engager 58 except that it has a non-threaded, outer surface 76 and a threaded, inner surface 78. The threaded, inner surface 78 is configured to be inserted into, and threadably engaged with, a cable connector.

Referring to FIGS. 5-8, in one embodiment, the signal carrier 62 is tubular and configured to receive a pin or inner conductor engager 80 of the cable connector 68. Depending upon the embodiment, the signal carrier 62 can have a plurality of fingers 82 which are spaced apart from each other about the perimeter of the signal carrier 80. When the cable inner conductor 84 is inserted into the signal carrier 80, the fingers 82 apply a radial, inward force to the inner conductor 84 to establish a physical and electrical connection with the inner conductor 84. The electrical connection enables data signals to be exchanged between the devices that are in communication with the interface port. In one embodiment, the electrical ground 60 is tubular and configured to mate with a connector ground 86 of the cable connector 68. The connector ground 86 extends an electrical ground path to the ground 64 as described below.

Cables

In one embodiment illustrated in FIGS. 4 and 8-10, the networks 2 and 12 include one or more types of coaxial cables 88. In the embodiment illustrated in FIG. 8, the coaxial cable 88 has: (a) a conductive, central wire, tube, strand or inner conductor 84 that extends along a longitudinal axis 92 in a forward direction F toward the interface port 56; (b) a cylindrical or tubular dielectric, or insulator 96 that receives and surrounds the inner conductor 84; (c) a conductive tube or outer conductor 98 that receives and surrounds the insulator 96; and (d) a sheath, sleeve or jacket 100 that receives and surrounds the outer conductor 98. In the illustrated embodiment, the outer conductor 98 is corrugated, having a spiral, exterior surface 102. The exterior surface 102 defines a plurality of peaks and valleys to facilitate flexing or bending of the cable 88 relative to the longitudinal axis 92.

Figure 8:
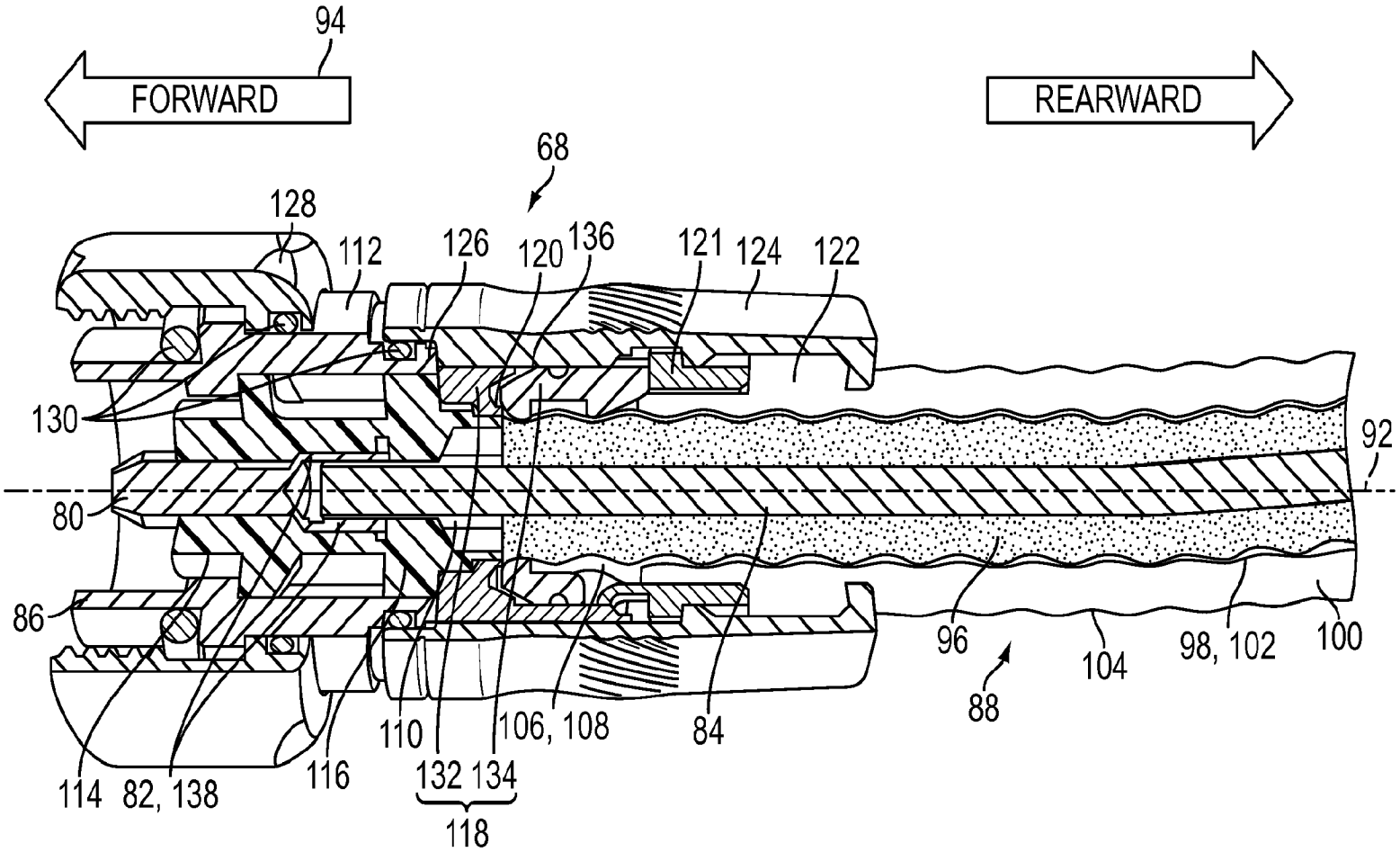
FIG. 8 is an isometric, cut-away view of one embodiment of a cable connector and cable.

To achieve the cable configuration shown in FIG. 8, an assembler/preparer, in one embodiment, takes one or more steps to prepare the cable 90 for attachment to the cable connector 68. In one example, the steps include: (a) removing a longitudinal section of the jacket 104 to expose the bare surface 106 of the outer conductor 108; (b) removing a longitudinal section of the outer conductor 108 and insulator 96 so that a protruding end 110 of the inner conductor 84 extends forward, beyond the recessed outer conductor 108 and the insulator 96, forming a step-shape at the end of the cable 68; (c) removing or coring-out a section of the recessed insulator 96 so that the forward-most end of the outer conductor 106 protrudes forward of the insulator 96.

In another embodiment not shown, the cables of the networks 2 and 12 include one or more types of fiber optic cables. Each fiber optic cable includes a group of elongated light signal guides or flexible tubes. Each tube is configured to distribute a light-based or optical data signal to the networks 2 and 12.

Connectors

In the embodiment illustrated in FIG. 8, the cable connector 68 includes: (a) a connector housing or connector body 112; (b) a connector insulator 114 received by, and housed within, the connector body 112; (c) the inner conductor engager 80 received by, and slidably positioned within, the connector insulator 114; (d) a driver 116 configured to axially drive the inner conductor engager 80 into the connector insulator 114 as described below; (e) an outer conductor clamp device or outer conductor clamp assembly 118 configured to clamp, sandwich, and lock onto the end section 120 of the outer conductor 106; (f) a clamp driver 121; (g) a tubular-shaped, deformable, environmental seal 122 that receives the jacket 104; (h) a compressor 124 that receives the seal 122, clamp driver 121, clamp assembly 118, and the rearward end 126 of the connector body 112; (i) a nut, fastener or coupler 128 that receives, and rotates relative to, the connector body 112; and (j) a plurality of 0-rings or ring-shaped environmental seals 130. The environmental seals 122 and 130 are configured to deform under pressure so as to fill cavities to block the ingress of environmental elements, such as rain, snow, ice, salt, dust, debris and air pressure, into the connector 68.

In one embodiment, the clamp assembly 118 includes: (a) a supportive outer conductor engager 132 configured to be inserted into part of the outer conductor 106; and (b) a compressive outer conductor engager 134 configured to mate with the supportive outer conductor engager 132. During attachment of the connector 68 to the cable 88, the cable 88 is inserted into the central cavity of the connector 68. Next, a technician uses a hand-operated, or power, tool to hold the connector body 112 in place while axially pushing the compressor 124 in a forward direction F. For the purposes of establishing a frame of reference, the forward direction F is toward interface port 55 and the rearward direction R is away from the interface port 55.

The compressor 124 has an inner, tapered surface 136 defining a ramp and interlocks with the clamp driver 121. As the compressor 124 moves forward, the clamp driver 121 is urged forward which, in turn, pushes the compressive outer conductor engager 134 toward the supportive outer conductor engager 132. The engagers 132 and 134 sandwich the outer conductor end 120 positioned between the engagers 132 and 134. Also, as the compressor 124 moves forward, the tapered surface or ramp 136 applies an inward, radial force that compresses the engagers 132 and 134, establishing a lock onto the outer conductor end 120. Furthermore, the compressor 124 urges the driver 121 forward which, in turn, pushes the inner conductor engager 80 into the connector insulator 114.

The connector insulator 114 has an inner, tapered surface with a diameter less than the outer diameter of the mouth or grasp 138 of the inner conductor engager 80. When the driver 116 pushes the grasp 138 into the insulator 114, the diameter of the grasp 138 is decreased to apply a radial, inward force on the inner conductor 84 of the cable 88. As a consequence, a bite or lock is produced on the inner conductor 84.

Figure 5:
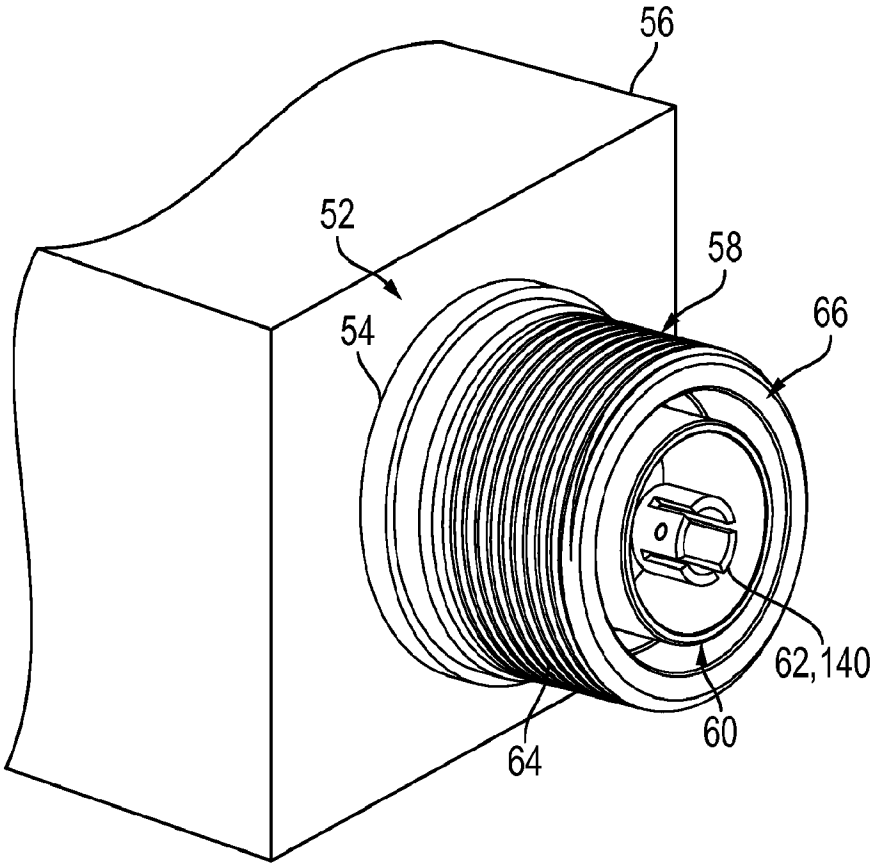
FIG. 5 is an isometric view of one embodiment of an interface port.

After the cable connector 68 is attached to the cable 88, a technician or user can install the connector 68 onto an interface port, such as the interface port 52 illustrated in FIG. 5. In one example, the user screws the coupler 128 onto the port 52 until the fingers 140 of the signal carrier 62 receive, and make physical contact with, the inner conductor engager 80 and until the ground 60 engages, and makes physical contact with, the outer conductor engager 86. During operation, the non-conductive, connector insulator 114 and the non-conductive driver 116 serve as electrical barriers between the inner conductor engager 80 and the one or more electrical ground paths surrounding the inner conductor engager 80. As a result, the likelihood of an electrical short is mitigated, reduced or eliminated. One electrical ground path extends: (i) from the outer conductor 106 to the clamp assembly 118, (ii) from the conductive clamp assembly 118 to the conductive connector body 112, and (iii) from the conductive connector body 112 to the conductive ground 60. An additional or alternative electrical grounding path extends: (i) from the outer conductor 106 to the clamp assembly 118, (ii) from the conductive clamp assembly 118 to the conductive connector body 112, (iii) from the conductive connector body 112 to the conductive coupler 128, and (iv) from the conductive coupler 128 to the conductive ground 60.

These one or more grounding paths provide an outlet for electrical current resulting from magnetic radiation in the vicinity of the cable connector 88. For example, electrical equipment operating near the connector 68 can have electrical current resulting in magnetic fields, and the magnetic fields could interfere with the data signals flowing through the inner conductor 84. The grounded outer conductor 106 shields the inner conductor 84 from such potentially interfering magnetic fields. Also, the electrical current flowing through the inner conductor 84 can produce a magnetic field that can interfere with the proper function of electrical equipment near the cable 88. The grounded outer conductor 106 also shields such equipment from such potentially interfering magnetic fields.

The internal components of the connector 68 are compressed and interlocked in fixed positions under relatively high force. These interlocked, fixed positions reduce the likelihood of loose internal parts that can cause undesirable levels of passive intermodulation ("PIM") which, in turn, can impair the performance of electronic devices operating on the networks 2 and 12. PIM can occur when signals at two or more frequencies mix with each other in a non-linear manner to produce spurious signals. The spurious signals can interfere with, or otherwise disrupt, the proper operation of the electronic devices operating on the networks 2 and 12. Also, PIM can cause interfering RF signals that can disrupt communication between the electronic devices operating on the networks 2 and 12.

In one embodiment where the cables of the networks 2 and 12 include fiber optic cables, such cables include fiber optic cable connectors. The fiber optic cable connectors operatively couple the optic tubes to each other. This enables the distribution of light-based signals between different cables and between different network devices.

Supplemental Grounding

Figure 4:
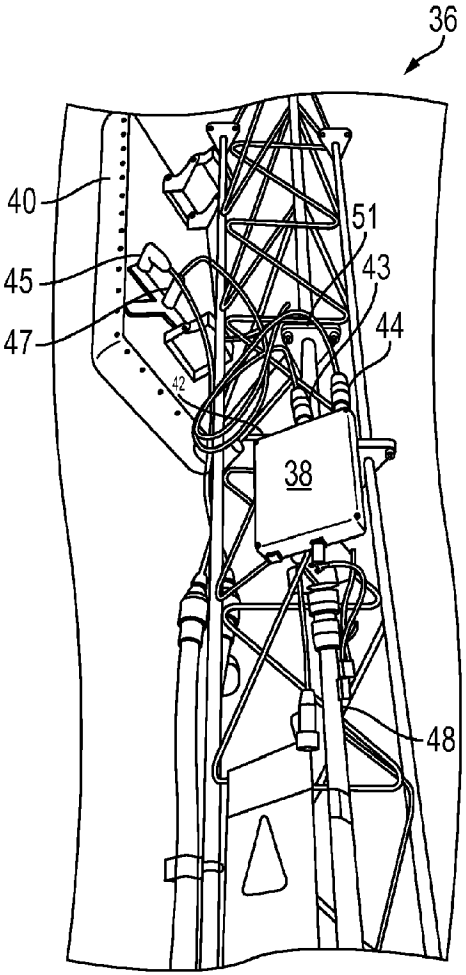
FIG. 4 is an isometric view of one embodiment of a tower.

In one embodiment, grounding devices are mounted to towers such as the tower 36 illustrated in FIG. 4. For example, a grounding kit or grounding device can include a grounding wire and a cable fastener which fastens the grounding wire to the outer conductor 106 of the cable 88. The grounding device can also include: (a) a ground fastener which fastens the ground wire to a grounded part of the tower 36; and (b) a mount which, for example, mounts the grounding device to the tower 36. In operation, the grounding device provides an additional ground path for supplemental grounding of the cables 88.

Environmental Protection

Figure 9:
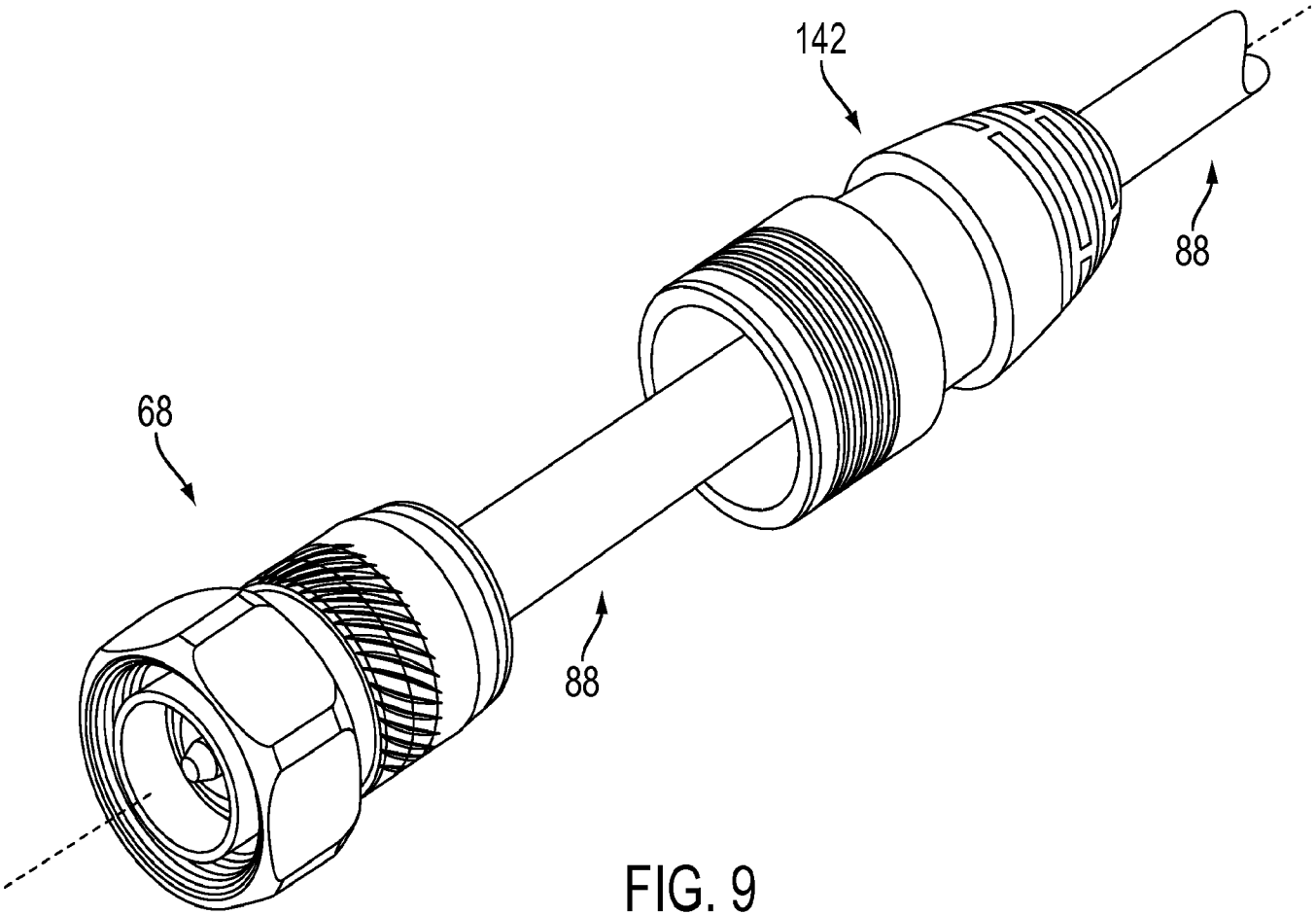
FIG. 9 is an isometric, exploded view of one embodiment of a cable assembly having a water resistant cover.
Figure 10:
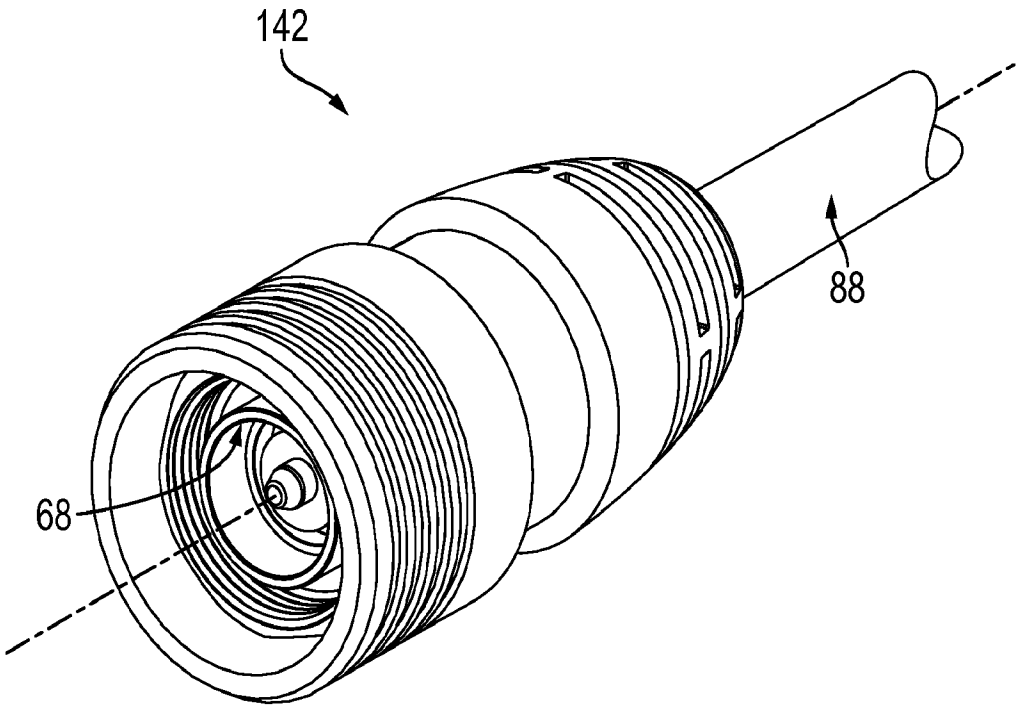
FIG. 10 is an isometric view of one embodiment of a cable connector covered by a water resistant cover.

In one embodiment, a protective boot or cover, such as the cover 142 illustrated in FIGS. 9-10, is configured to enclose part or all of the cable connector 88. In another embodiment, the cover 142 extends axially to cover the connector 68, the physical interface between the connector 68 and the interface port 52, and part or all of the interface port 52. The cover 142 provides an environmental seal to prevent the infiltration of environmental elements, such as rain, snow, ice, salt, dust, debris and air pressure, into the connector 68 and the interface port 52. Depending upon the embodiment, the cover 142 may have a suitable foldable, stretchable or flexible construction or characteristic. In one embodiment, the cover 142 may have a plurality of different inner diameters. Each diameter corresponds to a different diameter of the cable 88 or connector 68. As such, the inner surface of cover 142 conforms to, and physically engages, the outer surfaces of the cable 88 and the connector 68 to establish a tight environmental seal. The air-tight seal reduces cavities for the entry or accumulation of air, gas and environmental elements.

Materials

In one embodiment, the cable 88, connector 68 and interface ports 52, 53 and 55 have conductive components, such as the inner conductor 84, inner conductor engager 80, outer conductor 106, clamp assembly 118, connector body 112, coupler 128, ground 60 and the signal carrier 62. Such components are constructed of a conductive material suitable for electrical conductivity and, in the case of inner conductor 84 and inner conductor engager 80, data signal transmission. Depending upon the embodiment, such components can be constructed of a suitable metal or metal alloy including copper, but not limited to, copper-clad aluminum ("CCA"), copper-clad steel ("CCS") or silver-coated copper-clad steel ("SCCCS").

The flexible, compliant and deformable components, such as the jacket 104, environmental seals 122 and 130, and the cover 142 are, in one embodiment, constructed of a suitable, flexible material such as polyvinyl chloride (PVC), synthetic rubber, natural rubber or a silicon-based material. In one embodiment, the jacket 104 and cover 142 have a lead-free formulation including black-colored PVC and a sunlight resistant additive or sunlight resistant chemical structure. In one embodiment, the jacket 104 and cover 142 weatherize the cable 88 and connection interfaces by providing additional weather protective and durability enhancement characteristics. These characteristics enable the weatherized cable 88 to withstand degradation factors caused by outdoor exposure to weather.

2.0 Tip End Contact For Center Conductor

Significant investigation/study had gone into the interface between a signal-carrying center, or inner conductor and a conductive receptacle/pin engager of a connector/interface port. Important variables include: (a) the impedance at, or along, the interface which is a function of the electrical properties of the materials between the inner and outer conductors, (b) the electrical conductivity at the interface between the inner conductor and the inner conductor engager, and (c) the mechanical properties holding the coaxial cable to the connector/interface port.

Figure 11:
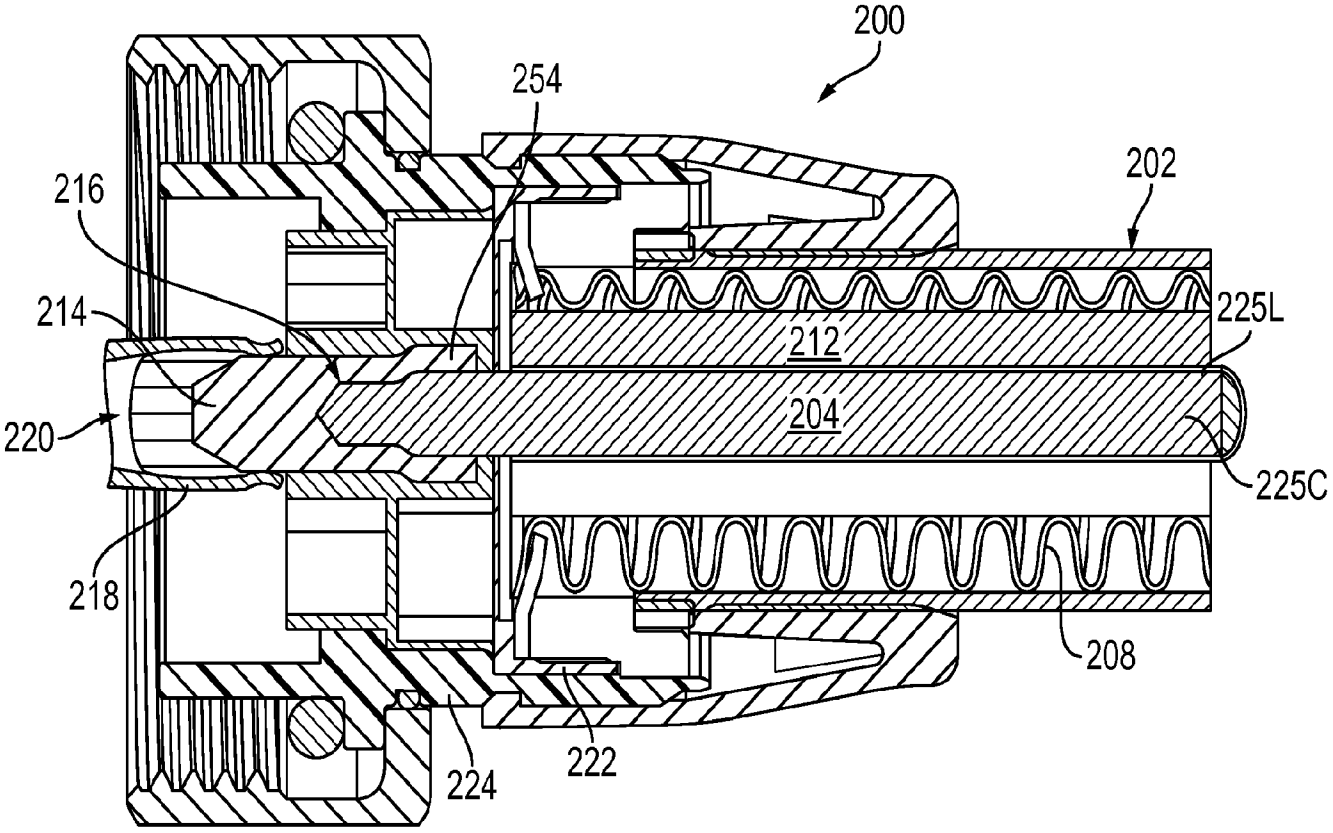
FIG. 11 is a broken-away profile view of a coaxial cable employing a tip end conductor or pin for a center conductor which is configured for providing enhanced mechanical and electrical properties.

FIG. 11 depicts a broken-away section view of a connector 200 coupling to a spiral superflex coaxial cable 202. The cable 202 includes: (i) a center or inner, signal-carrying conductor 204, (ii) a spiral outer grounding conductor 208 surrounding/circumscribing the inner conductor 204, and (iii) a dielectric core 212 interposing the inner and outer conductors 204, 208. An electrically-augmenting pin, tip, or tip-end contact 214 couples to the outermost tip or terminal end 216 of the inner conductor 204 and comprises a highly conductive copper/copper alloy material. Copper alloys such as brass, i.e., a mixture of copper and tin, may also be used. The electrically-augmenting tip end contact 214 of the inner conductor 204 receives, and engages, a plurality of resilient fingers 218 of an inner conductor engager 220.

In the illustrated embodiment, the inner conductor engager 220 electrically connects to a threaded interface port (not shown) or may be centered by a spool-shaped retainer (also not shown) within a forward end portion of a threaded coupling connection. The outer conductor 208 is a corrugated spiral having a regular pitch dimension between peeks, similar to an external thread. The outer conductor 208 electrically connects to an annular ring 222 which, in turn, engages a conductive outer body 224 of the connector 200.

In the described embodiment, the center conductor 204 comprises an aluminum/aluminum alloy core 225C having an outer layer 225L of a copper/copper alloy cladding. The thickness of the clad outer layer 225L is about 0.00055 to 0.00060 but may be thinner or thicker depending upon the electrical properties sought and the manufacturing process employed. The tensile strength of the copper clad aluminum/aluminum alloy is greater than about 800 MPa and has a conductivity of greater than about 0.4 mho/cm. The electrically-augmenting tip end contact 214 has a shear strength approximately equal to the shear strength of the mating aluminum center conductor 204 and has a conductivity of greater than about 0.6 mho/cm.

FIGS. 12-15, depict several embodiments of the tip end contacts 214, 314, 414, 514 configured to engage the respective mating aluminum center conductor 204. Each of the tip end contacts 214, 314, 414, 514 segregate the mechanical and electrical paths to improve the mechanical and electrical properties of the connector 200, i.e., the mechanical tensile strength, electrical conductivity, resistance and impedance at the interface between the center conductor 204 and each of the tip end contacts 214, 314, 414, 514.

Figure 12:
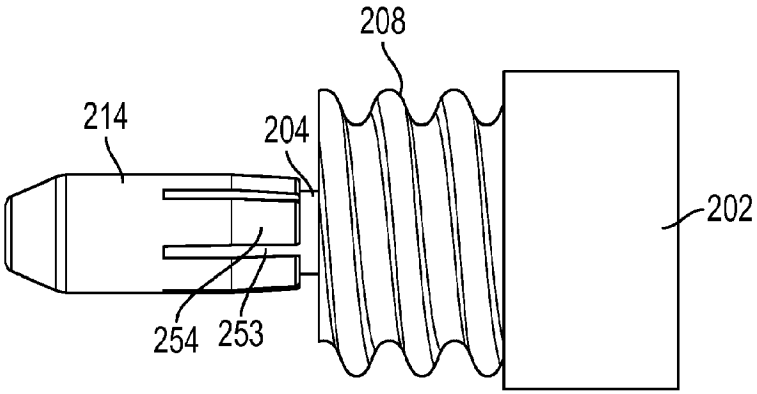
FIG. 12 is an isolated side view of the tip end conductor disposed in combination with a super-flex hardline coaxial cable.
Figure 13:
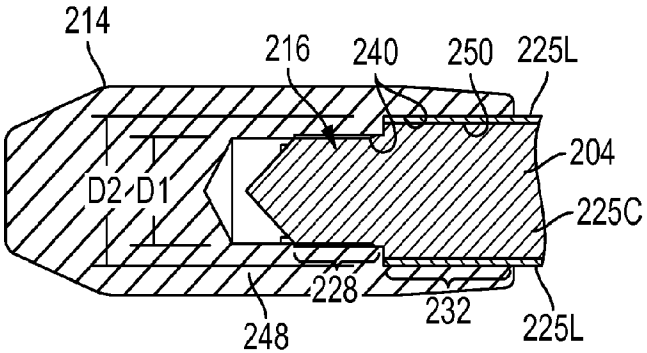
FIG. 13 is an enlarged cross-sectional view of one embodiment of the tip end conductor which is press fit onto a stepped center conductor of the coaxial cable.

In FIGS. 11-13, the terminal end 216 of the aluminum inner conductor 204 is stepped to define a first or inboard region 228 proximal to the inner conductor engager 220 (FIG. 11) and a second or outboard region 232 away from the inner conductor engager 220 and toward the outer conductor 208 of the coaxial cable 202. The first and second regions 228, 232 are configured such that the first region 228 has a diameter D1 which is less than the diameter D2 of the second region 232. The diameter D2 generally corresponds to the full diameter of the aluminum inner conductor 204 of the coaxial cable 202.

The tip end conductor 214 comprises first and second portions 214*a*, 214*b* corresponding to the first and second regions 228, 232 of the terminal end 216 of the inner conductor 204. The first and second portions 214*a*, 214*b* include a machined bore 240 having a stepped internal geometry which complements the stepped outer geometry of the terminal end 216 of the inner conductor 202. More specifically, the machined bore 240 includes first and second aligned cavities 248, 252 which correspond to, and compliment, the first and second regions 228, 232, respectively, of the outermost tip 216 of the aluminum inner conductor 204. In the described embodiment, the second portion 214*b* includes a plurality of axial slots 253 forming a plurality of engagement fingers 254 each having a slightly inward bend or bias.

The terminal end 216 of the inner conductor 204 is press-fit into the first portion 214*a*, i.e., into the first aligned cavity 248 of the tip end conductor 214 to produce a robust mechanical connection along the first region 228, or diameter D1, of the inner conductor 204. As the terminal end 216 is pressed into the cavity 248, the engagement fingers 254 of the second cavity 252, along the second region 232, or diameter D2, produces a highly efficient electrical connection. More specifically, the step produced along the first region 228, or diameter D1, removes the copper cladding 225L to facilitate the creation of the strong press/friction fit connection while allowing for the bias of the fingers 254 to firmly engage the inner conductor 204 along the second region 232, or diameter D2 thereof. Furthermore, the step produced in the first region 228 reduces (i) the diameter of the conductive outer body 224 (to maintain a desired impedance value), and (ii) the diameter of the coaxial cable 202. Moreover, the second cavity 252 of the tip end conductor 214 mates with the layer 225L of cladding along the external surface of the inner conductor 204. This copper to copper interface, i.e., the interface between the tip end conductor 214 and the copper cladding, decreases electrical resistance and improves RF performance across the interface.

Figure 14:
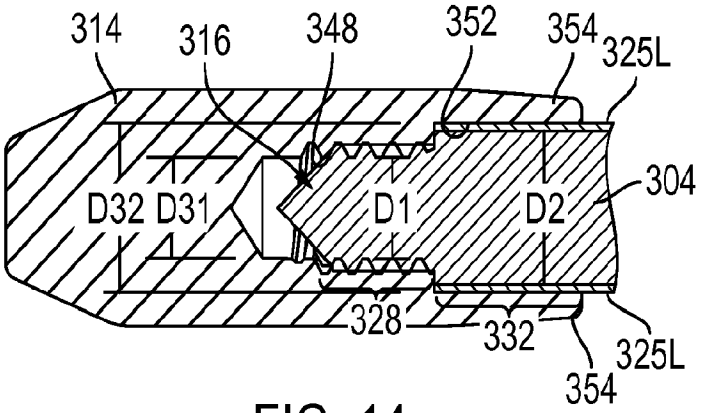
FIG. 14 is a cross-sectional view of another embodiment of the tip end conductor which is threadably connected to a stepped end of center conductor.

In FIG. 14, a first cavity 348 of the tip end conductor 314 is threaded to threadably engage a threaded first region 328 of an aluminum inner conductor 304. The second cavity 352 frictionally engages a cylindrical second region 332 of the aluminum inner conductor 304 as the tip end conductor 314 threadably engages the first region 328. In the described embodiment, and similar to the previous embodiment, the second cavity 352 includes a plurality of axial slots 353 forming a plurality of engagement fingers 354 each having a slightly inward bend or bias. The threaded interface, along the first region 328, mechanically couples the tip end conductor 314 to the inner conductor 304 while the engagement fingers 353 frictionally engage the second region 332 of the inner conductor 304. While this embodiment shows a threaded interface along the first region, it will be appreciated that other irregular surfaces, e.g., teeth, may be employed to enhance the axial retention along the first region 328.

The threads 328 along the first region 328 of the inner conductor 304 threadably engage the threaded root diameter D31 of the tip end conductor 314. The threaded connection produces a robust mechanical connection along the first region 328 of the inner conductor 304. Furthermore, as the tip end conductor 314 is rotated to form the threaded connection, the engagement fingers 354 slide along the second region 332, along the diameter D22, to produce a highly efficient electrical connection. Moreover, the step produced along the first region 328, or diameter D31, removes the copper cladding 325L to facilitate the creation of the strong threaded connection while the biased fingers 354 firmly engage the inner conductor 304 along the second region 332, or diameter D32 thereof.

Similar to the previous embodiment, the step produced in the first region 328 reduces (i) the diameter of the conductive outer body 224 (to maintain a desired impedance value), and (ii) the diameter of the coaxial cable 202. Moreover, the second cavity 352 of the tip end conductor 314 mates with the layer 325L of cladding along the external surface of the inner conductor 304. This copper-to-copper interface, i.e., the interface between the tip end conductor 314 and the copper cladding 325L, decreases electrical resistance and improves RF performance across the interface.

Figure 15:
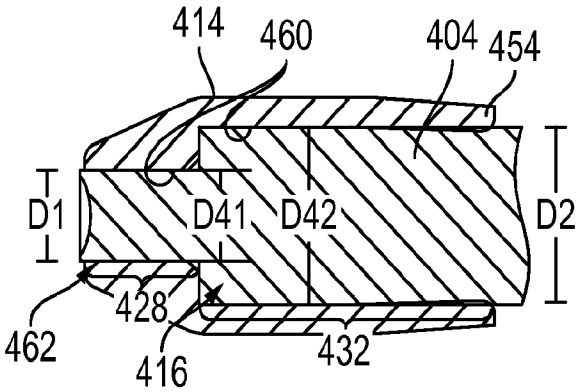
FIG. 15 is a cross-sectional view of another embodiment of the c tip end conductor which is connected by peening the stepped end of the center conductor to connect a conductive conductor tip.

In FIG. 15, a tip end conductor 414 includes a stepped bore 460 having first and second diameters D41, D42 corresponding to first and second diameters D1, D2 of an inner conductor 404. The forward, or open end, of the stepped bore 460 receives the terminal end 416 of the inner conductor 404 such that it is accessible from the forward end 462, i.e., the end proximal to the center conductor engager 220 (see FIG. 11). The tip end conductor 414 is subject to peening deformation to axially deform the terminal end 416 such that the ductile aluminum inner conductor 404 radially deforms against the inner surface of the stepped bore 460. Radial deformation produces a mechanical friction-fit connection between the terminal end 416 of the inner conductor 404 and the tip end conductor 414. In the described embodiment, the aft end of the stepped bore 460 also includes a plurality of axial slots forming a plurality of engagement fingers 454 each having a slightly inward bend or bias.

The peened end 462 produces a robust mechanical connection while the engagement fingers 454 produce an efficient electrical interface between the center conductor tip end conductor 414 and the terminal end 416 of the inner conductor 404. Similar to the prior embodiments, the diameter of the tip end conductor 414 may be reduced to decrease the impedance and, in turn, the diameter of the coaxial cable 202 (FIG. 11). The electrical properties are enhanced by the copper-to-copper interface between the conductive tip end 414 and the aluminum center conductor 404.

Figure 16:
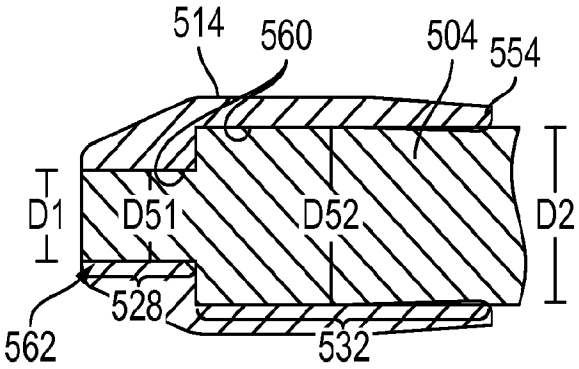
FIG. 16 is a cross-sectional view of another embodiment of the tip end conductor which is connected by welding/fusing/bonding the stepped end of the center conductor to connect a conductive conductor tip.

In FIG. 16, a center conductor tip end conductor 514 also includes a stepped bore 560 having first and second diameters D51, D52 corresponding to the first and second diameters D1, D2 of an inner conductor 504. The forward, or open end, of the stepped bore 560 receives the terminal end 516 of the inner conductor 504 such that it is accessible from the forward end 562, i.e., the end proximal to the center conductor engager 220 (see FIG. 11). The terminal end 516 is welded/fused/bonded to the tip end conductor 514 through the open end 562 to produce an integral connection between the terminal end 516 of the inner conductor 504 and the tip end conductor 514. In the described embodiment, the aft end of the stepped bore 560 also includes a plurality of axial slots forming a plurality of engagement fingers 554 each having a slightly inward bend or bias.

The metal bonded/welded end 562 produces a robust mechanical connection while the engagement fingers 554 produce an efficient electrical interface between the center conductor tip end conductor 514 of the inner conductor 504. Similar to the prior embodiments, the diameter of the tip end conductor 514 may be reduced to decrease the impedance and, in turn, the diameter of the coaxial cable 202 (FIG. 11). The electrical properties are enhanced by the copper-to-copper interface between the conductive tip end 514 and the aluminum center conductor 504.

Figure 17:
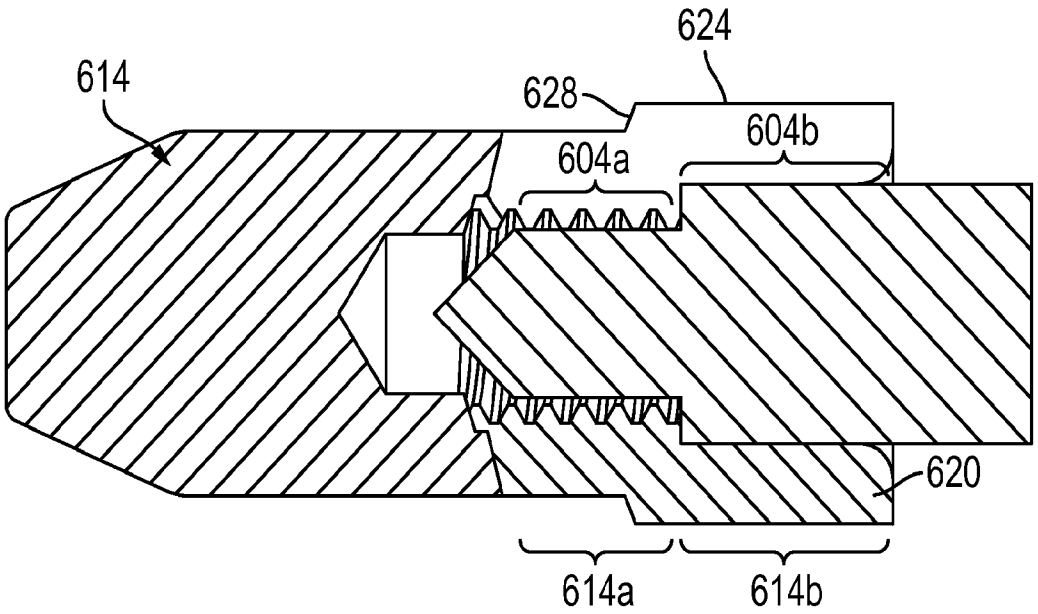
FIG. 17 is a cross-sectional view of another embodiment of the tip end conductor wherein the second portion includes a plurality of complaint fingers and wherein each finger includes an tapered step configured to engage a tapered aperture of an interface port to urge the fingers into frictional engagement with the second region of the inner conductor.
Figure 18:
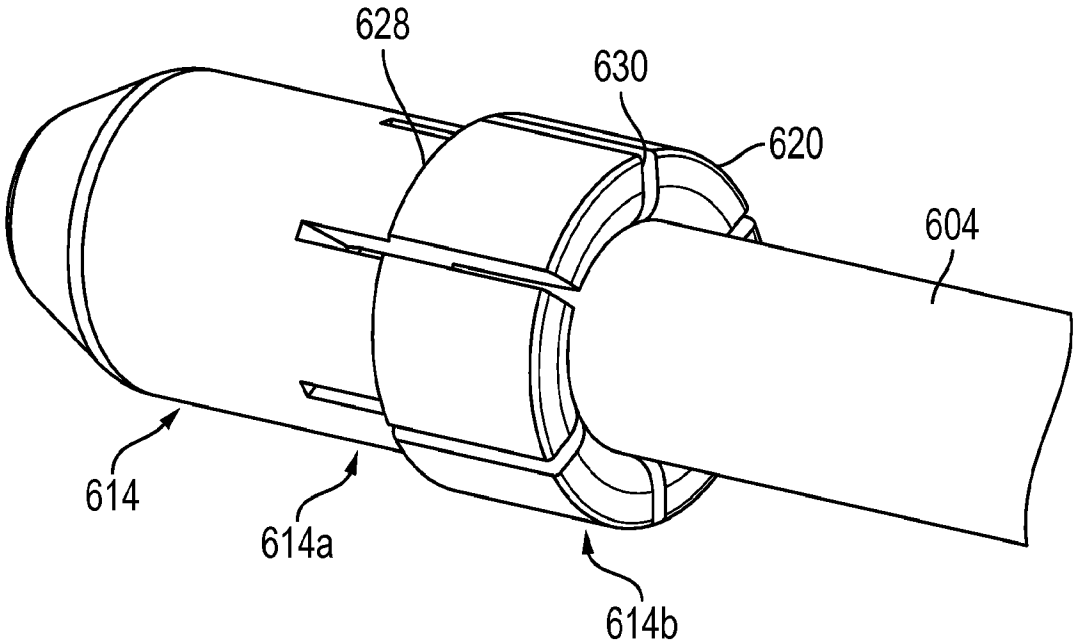
FIG. 18 is a perspective view of the tip end conductor shown in FIG. 17 wherein the elongate slots extend through, or past, the stepped surface of the complaint fingers.

FIGS. 17 and 18 depict another embodiment of the tip end conductor 614 wherein the second portion 614*b* thereof includes a plurality of compliant fingers 620 each including a tapered step 624 configured to engage a tapered aperture (not shown) of an interface port (also not shown) to urge the compliant fingers 620 into frictional engagement with the second region 604*b* of the inner conductor 604. In the described embodiment, the elongate slots 630 forming the fingers 620 are cut through or past the outboard edge 628 of the tapered step 624 of each finger 620, into the first portion 614*a* of the tip end conductor 614. By cutting the elongate slots 630 into the first portion 614*a* the fingers are sufficiently compliant to allow the tapered aperture to drive the fingers 620 into frictional engagement with the second region 614*b* of the inner conductor 604.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Coaxial Cable Connector Having An RF Shielding Member Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. A coaxial cable, comprising:

a cable having an inner conductor, an outer conductor and a dielectric material disposed therebetween, the inner conductor having an aluminum core, and an outer copper cladding disposed over the aluminum core;

the inner conductor defining a stepped transition producing a diameter reduction from an inboard copper cladding to a tip end aluminum core; and a tip end conductor having first and second cavities, the first cavity engaging the tip end aluminum core to mechanically engage the inner conductor; and the second cavity engaging the inboard copper cladding to electrically engage the inner conductor.

2. The coaxial cable of claim 1, wherein the inboard copper cladding corresponds to a maximum diameter dimension of the inner conductor.

3. The coaxial cable of claim 1, wherein the first and second cavities of the tip end conductor are aligned, the first aligned cavity defining a diameter dimension which is less than a diameter dimension of the second aligned cavity.

4. The coaxial cable of claim 1, wherein the first cavity of the tip end conductor includes a mechanically irregular inner surface, wherein the second cavity of the tip end conductor includes an electrically smooth inner surface, and wherein the tip end conductor is press fit onto the tip end aluminum core of the inner conductor such that the mechanically irregular inner surface produces a mechanical interlock along the mating interface to produce a robust mechanical connection between the tip end aluminum core and the first cavity of the tip end conductor.

5. The coaxial cable of claim 4, wherein the irregular surface of the first cavity is a spiral thread.

6. The coaxial cable of claim 4, wherein the second cavity of the tip end conductor includes an a plurality of elongate slots to produce a plurality of spring-biased fingers, and wherein the spring-biased fingers are biased inwardly to frictionally engage the outer copper cladding of the inner conductor to augment the flow of electrical current between the outer copper cladding and the tip end conductor.

7. The coaxial cable of claim 6, wherein each complaint finger includes a tapered surface configured to engage a tapered aperture of an interface port to urge the fingers into frictional engagement with the outer copper cladding of the inner conductor.

8. The coaxial cable of claim 6, wherein the elongate slots separating the compliant fingers extends across the first and second diameters of the first and second cavities.

9. The coaxial cable of claim 1, wherein the first cavity of the tip end conductor and the tip end aluminum core of the inner conductor define a threaded interface.

10. The coaxial cable of claim 1, wherein the first and second cavities of the tip end conductor define a through bore having first and second diameters, respectively, and wherein the through bore is open at each end of the tip end conductor to facilitate a mechanical connection along a mating interface between the first cavity of the tip end conductor and the tip end aluminum core of the inner conductor.

11. The coaxial cable of claim 10, wherein the mechanical connection is formed by shot peen deformation of the tip end aluminum core through an open end of the stepped bore.

12. The coaxial cable of claim 10, wherein the mechanical connection is formed by welding the tip end aluminum core through an open end of the stepped bore.

13. A tip end conductor for an inner conductor of a coaxial cable, comprising:

first and second cavities configured to be disposed over a tip end of the inner conductor, the tip end being prepared to expose the inner aluminum core of the inner conductor such that the inner aluminum core extends axially beyond an exposed outer copper cladding of the inner conductor, the first cavity configured to mechanically engage the exposed inner aluminum core; and the second cavity configured to electrically engage the exposed outer copper cladding of the inner conductor.

14. The tip end conductor of claim 13, wherein the inboard copper cladding corresponds to a maximum diameter dimension of the inner conductor.

15. The tip end conductor of claim 13, wherein the first and second cavities define first and second diameter dimensions, respectively, wherein the first diameter dimension is less than the second diameter dimension.

16. The tip end conductor of claim 13, wherein the first cavity of the tip end conductor includes a mechanically irregular inner surface, and wherein the tip end conductor is press fit onto the tip end aluminum core of the inner conductor such that the mechanically irregular inner surface produces a mechanical interlock along the mating interface to produce a robust mechanical connection between the tip end aluminum core and the first cavity of the tip end conductor.

17. The tip end conductor of claim 16, wherein the irregular surface of the first cavity is a spiral thread.

18. The tip end conductor of claim 16, wherein the second cavity of the tip end conductor includes an electrically smooth surface for slidably engaging the exposed outer copper cladding of the inner conductor.

19. The tip end conductor of claim 13 wherein the first cavity defines a plurality of threads for engaging a plurality of threads formed along the tip end aluminum core of the inner conductor.

20. The tip end conductor of claim 13, wherein the second cavity of the tip end conductor includes an a plurality of elongate slots to produce a plurality of spring-biased fingers, and wherein the spring-biased fingers are biased inwardly to frictionally engage the outer copper cladding of the inner conductor to augment the flow of electrical current between the outer copper cladding and the tip end conductor.

* * * * *